US006484548B2

(12) United States Patent
Siemer et al.

(10) Patent No.: US 6,484,548 B2
(45) Date of Patent: Nov. 26, 2002

(54) DRIVE SYSTEM FOR A METAL EXTRUSION PRESS

(75) Inventors: Ekhard Siemer, Haan (DE); Hans Günter Fleischer, Düsseldorf (DE)

(73) Assignee: SMS Eumuco GmbH, Leverkusen (DE)

( * ) Notice: Subject to any disclaimer, the term of this patent is extended or adjusted under 35 U.S.C. 154(b) by 0 days.

(21) Appl. No.: 09/783,757

(22) Filed: Feb. 15, 2001

(65) Prior Publication Data

US 2001/0023606 A1 Sep. 27, 2001

(30) Foreign Application Priority Data

Feb. 15, 2000 (DE) ..... 10006704

(51) Int. Cl.[7] ..... B21C 23/00

(52) U.S. Cl. ..... 72/253.1; 72/273.5; 72/453.06; 72/453.18; 100/269.08; 100/269.14

(58) Field of Search ..... 72/253.1, 273.5, 72/453.02, 453.06, 453.07, 453.18; 100/269.08, 269.09, 269.1, 269.14

(56) References Cited

U.S. PATENT DOCUMENTS

| | | | | |
|---|---|---|---|---|
| 3,357,227 A | * | 12/1967 | Walker et al. | 72/253.1 |
| 3,649,816 A | * | 3/1972 | Johnes et al. | 72/253.1 |
| 4,230,661 A | * | 10/1980 | Asari et al. | 72/273.5 |
| 4,379,398 A | * | 4/1983 | Asari et al. | 72/273.5 |

* cited by examiner

*Primary Examiner*—Ed Tolan
(74) *Attorney, Agent, or Firm*—Herbert Dubno

(57) ABSTRACT

A drive system for the container holder and the travelling beam of a metal extruder press in which a return stroke is accelerated by connecting the annular chambers of the travelling beam and container holder cylinders to a pressurization force and with the full piston area chambers of the container holder connected to a tank, connecting the full piston area chambers of the travelling beam to the pressure source as well.

2 Claims, 1 Drawing Sheet

DRIVE SYSTEM FOR A METAL EXTRUSION PRESS

FIELD OF THE INVENTION

The present invention relates to a drive system for a metal extrusion press and, more particularly, for the return movement of the container holder and the travelling beam of a metal extrusion press.

BACKGROUND OF THE INVENTION

A metal extrusion press can have a travelling beam provided with a ram which is juxtaposed with a counter beam which can support an extrusion die through which the metal of a billet held in a container on a container holder between the travelling beam and the counter beam is extended.

A cylinder beam can be provided with a main cylinder unit acting upon the travelling beam for driving the ram into the billet and the metal through the die and with auxiliary cylinder units for the travelling beam and the container holder.

The annular compartments of the auxiliary cylinders for the container holder can be pressurized for the return movement and the full-piston-area cylinder compartments can be connected with a tank. The auxiliary cylinder units for the container holder are thus able, in a first control phase to maintain a mechanical contact of the container holder against the travelling beam and then to shift the travelling beam via the container holder into a billet loading position.

For hydraulic extrusion presses it is important to minimize the time required to relieve the press, remove the billet residue from the container holder, load a new billet into the container holder and commence the pressing operation once again. The minimization of this time period results in an increase in productivity.

To achieve such a minimization in the return and refilling time, the velocity of the container holder and the travelling beam during their return or inactive strokes must be increased.

The pump capacity of the high pressure pump used for extrusion usually does not suffice for such high speed return strokes. It is possible to obtain the rapid movement by the use of additional high pressure pumps, auxiliary pumps or special means like additional accumulators or similar systems for augmenting the volume rate of flow of the hydraulic fluid.

It is, however, a drawback of such systems that they involve high investment or capital costs and additional electronic power and often require the installation of special units for effecting the inactive return displacement of the parts.

After extrusion, the extrusion press must have its elements moved away from one another to provide sufficient place for removing the container residue and introducing the new billet. In a first phase, the conductor or conductor holder and then travelling beam must be moved rearwardly parallel to one another. This is usually achieved with the cylinder units in a manner such that the container and the travelling beam is separately displaced or the container holder is brought into engagement with the travelling beam and then entrains the travelling beam with it. The moving parts are thus simultaneously or sequentially brought into the billet loading position. With the prior art cylinder arrangement of the extrusion press, differential switching is required to reduce the hydraulic volumetric displacement. This differential switching is also referred to as regenerative switching or as hydraulic pressure takeover.

In conventional practice this is used to accelerate the press closing or forward operation stage but not for a rapid return or separation operation.

OBJECT OF THE INVENTION

It is, therefore, an object of the invention to provide an improved metal extrusion press with a drive system which enables accelerated return movement of the container holder and the travelling beam entrained thereby significantly reducing the setup time for the next extrusion operation.

Another object of the invention is to provide a system for effecting such acceleration which does not require additional apparatus like further pumps or accumulators.

SUMMARY OF THE INVENTION

These objects and others which will become apparent hereinafter are attained, in accordance with the invention, in a metal extrusion press which comprises:

a traveling beam provided with a ram;

a counter beam supporting an extrusion die juxtaposed with the ram;

a container holder between the press beam and the counter beam and provided with a container receiver a billet of a metal to be extruded between the ram and the die;

a cylinder beam provided with a main cylinder unit comprised of at least one piston-and-cylinder assembly acting upon the traveling beam for driving the ram into the billet and the metal through the die, and with traveling-beam and container-holder auxiliary cylinder units each consisting of at least two piston-and-cylinder assemblies and respectively braced between the cylinder beam and, respectively, the traveling beam and the cylinder holder; and a hydraulic system connected to at least some of the piston-and-cylinder assemblies for a return stroke of the container holder and traveling beam, the piston-and-cylinder assemblies of the auxiliary cylinder units each having an annular cylinder chamber traversed by piston rods on one side of the respective assembly and a full-piston-area cylinder chamber on an opposite side of the respective assembly, the system pressurizing the annular cylinder chambers and connecting the full-piston-area cylinder chambers of the piston-and-cylinder assemblies of the auxiliary cylinder unit of the container holder to a tank. The auxiliary cylinder unit of the container holder maintains the container holder in mechanical entrainment with the traveling beam in a first phase and the traveling beam is thereafter pushed into an end position by the container holder, the system including means for connecting the annular cylinder chambers of the auxiliary cylinder units of the container holder and the traveling beam and the full-piston-area of the travelling beam to a hydraulic pressurization source simultaneously during the return stroke.

More particularly, during the back movement of the container holder, the ring chambers of the container auxiliary cylinders are connected to the hydraulic pressure source and the cylinder chambers on the opposite sides of the respective pistons, here referred to as the full piston area chambers, are connected to the tank via the valve unit. After the container holder comes into contact with the travelling beam, and after a short acceleration phase via the valve unit, the ring chambers auxiliary cylinder units of the travelling beam are connected with the full piston area cylinder units of the travelling beam auxiliary cylinder units in a hydraulic short circuit and simultaneously the valve unit returns the surplus hydraulic fluid generated by the mechanical entrainment of the travelling beam to the ring chambers of the auxiliary cylinder units of the container holder. The cylinder areas of the auxiliary units are so selected that the requisite force is maintained for the return movement of the container holder and the travelling beam.

The differential hydraulic switching which results from the foregoing insures that in the return stroke, the auxiliary cylinders for the container holder and the travelling beam will work together in the return movement and that the hydraulic fluid quantity which, in earlier systems, was simply discharged into the tank from the full piston area side of the auxiliary units of the travelling beam, can be fed to the ring chambers of the travelling beam and the container holder auxiliary cylinders to accelerate the return movement. As a consequence, for a given installed pump capacity as required for the press operation, the return speed can be increased and the recycling time shortened. The hydraulic fluid discharged from the full piston area cylinder chambers of the auxiliary cylinder units of the travelling beam, limited only by the hydraulic fluid requirements of the ring chambers of the auxiliary units, is returned by the pressurization unit to both the auxiliary cylinder units of the container holder and the travelling beam.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
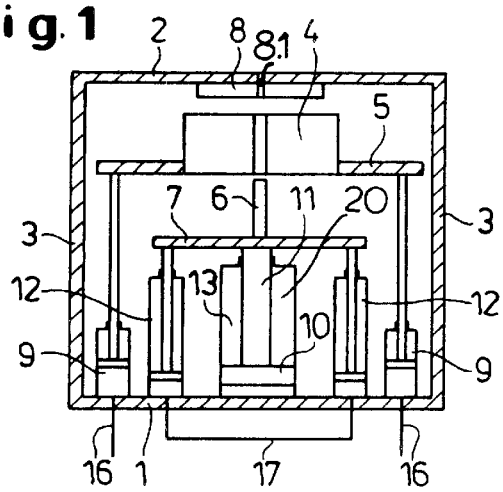
FIG. 1. is a cross sectional view in highly diagrammatic form of a metal extrusion press according to the invention showing the frame members only in schematic form.

The metal extrusion press shown in FIG. 1 comprises a cylinder beam 1, a counter beam 2 and tension rods or bars 3 connecting these two beams into the extrusion press frame.

Within this frame, a container holder 5 is displaceable toward and away from the counter beam 2, which carries the extrusion die 8, and is provided, in turn, with a container 4 holding a billet, the metal of which is to be extruded through the orifice 8.1 of the die 8.

A travelling beam 7 is likewise movable within the frame and is parallel to the container beam 5, the travelling beam 7 having a press ram 8 which is attached to drive the billet metal through the orifice 8.1.

In the illustrated system, for the socalled direct extrusion process, the die 8 is provided on the counter beam 2. In the case of the indirect extrusion process, the counter beam 2 would be provided with a ram.

The container holder 5 is displaceable by auxiliary piston and cylinder units 9 which press the container 4 and the billet contained therein against the die 8 during the extrusion process. The extrusion is effected by the minimum cylinder unit 20 which comprises a cylinder 13 having a piston 10 whose piston rod 12 acts upon the travelling beam 7 to drive the ram 8 into the billet in the container 4.

To remove the residue from the container and to enable a new billet to be introduced, the piston and cylinder units 9 retract the container holder 5 from the counter beam 2.

The retraction of the ram 6 or its advance in an accelerated manner to commence the extrusion operation is effected by the auxiliary piston and cylinder units 12.

Figure 2:
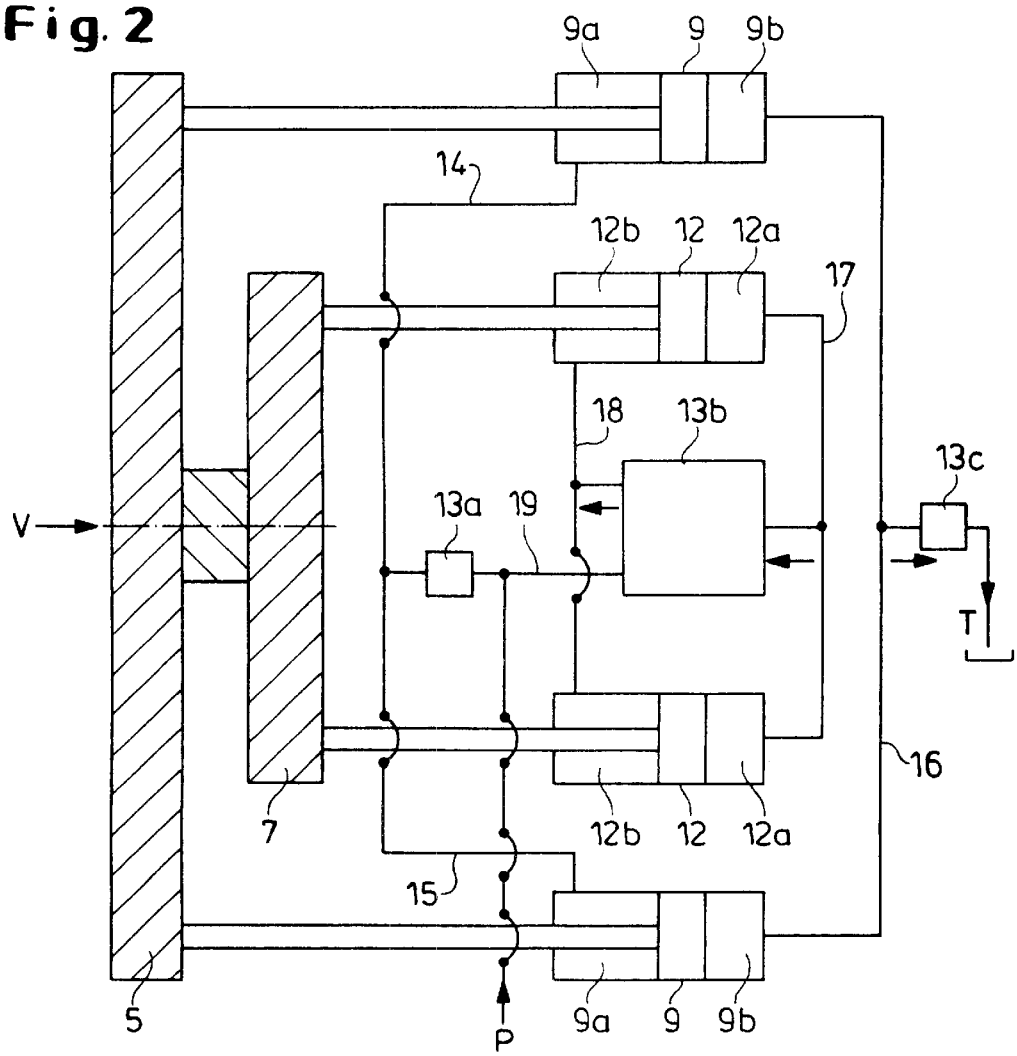
FIG. 2 is a detail, also in diagrammatic form illustrating the differential operation for the return movement or separating movement of the press in an accelerated manner according to the invention.

For accelerated retraction of the container holder 5 and the travelling beam 7, the container holder 5 is initially brought into mechanical engagement with the travelling beam 7 as has been illustrated in FIG. 2 by connecting the ring-shaped cylinder chambers 9*a* to the hydraulic fluid pressure connection P and supplying the fluid pressure via valve 13*a* to the lines 14 and 15 while the full-piston-area chambers 9*b* are connected via valve 13*c* with the tank T so that the displaced fluid can flow off.

For the accelerated retraction or return movement of the container holder 5 with the travelling beam 7 engaged thereby, the full-piston-area chambers 12*a* of the cylinder units 12 are connected by a common line 17 through the valve 13*b* to the branches 18 and 19 connected to the ring chambers 9*a* of the cylinders 9 and the ring chambers 12*b* of the cylinders 12 of the container holder and the travelling beam respectively. The hydraulic fluid displaced from the full-piston-area chambers 12a thus contributes to the hydraulic fluid volume supplied to the annular chambers 9*a* and 12*b*.

We claim:

1. A metal extrusion press comprising:

a traveling beam provided with a ram;

a counter beam supporting an extrusion die juxtaposed with said ram;

a container holder between said travelling beam and said counter beam and provided with a container receiving a billet of a metal to be extruded between said ram and said die;

a cylinder beam provided with a main cylinder unit comprised of at least one piston-and-cylinder assembly acting upon said traveling beam for driving said ram into said billet and said metal through said die, and with traveling-beam and container-holder auxiliary cylinder units each consisting of at least two piston-and-cylinder assemblies and respectively braced between said cylinder beam and, respectively, said traveling beam and said container holder; and a hydraulic system connected to at least some of said piston-and-cylinder assemblies for a return stroke of said container holder and traveling beam, said piston-and-cylinder assemblies of said auxiliary cylinder units each having an annular cylinder chamber traversed by piston rods on one side of the respective assembly and a full-piston-area cylinder chamber on an opposite side of the respective assembly, said system pressurizing said annular cylinder chambers and connecting the full-piston-area cylinder chambers of the piston-and-cylinder assemblies of the auxiliary cylinder unit of said container holder to a tank whereby the auxiliary cylinder unit of said container holder maintains said container holder in mechanical entrainment with said traveling beam in a first phase and the traveling beam is thereafter pushed into an end position by the container holder, said system including means for connecting said annular cylinder chambers of said auxiliary cylinder units of said container holder and said traveling beam and said full-piston-area cylinder chambers of the auxiliary cylinder units of said travelling beam to a hydraulic pressurization source simultaneously during said return stroke, with the full-piston-area cylinder chambers of the piston-and-cylinder assemblies of the auxiliary cylinder units of the traveling beam being short circuited to the annular cylinder chambers thereof, the full-piston-area cylinder chambers of the piston-and-cylinder assemblies of each of said units being directly connected together.

2. A method of operating a metal extrusion press having a traveling beam provided with a ram, a counter beam supporting an extrusion die juxtaposed with said ram, a container holder between said travelling beam and said counter beam and provided with a container receiver a billet of a metal to be extruded between said ram and said die, a cylinder beam provided with a main cylinder unit comprised of at least one piston-and-cylinder assembly acting upon said traveling beam for driving said ram into said billet and said metal through said die, and with traveling-beam and container-holder auxiliary cylinder units each consisting of at least two piston-and-cylinder assemblies and respectively braced between said cylinder beam and, respectively, said traveling beam and said cylinder holder, and a hydraulic system connected to said piston and cylinder assemblies, said method comprising the steps of:

a) in a return stroke of said press, retracting said container holder by hydraulically pressurizing annular cylinder chambers of said piston and cylinder assemblies of said container holder while connecting full-piston-area cylinder chambers thereof to a tank, thereby bringing said container holder into engagement with said travelling beam; and b) thereafter hydraulically pressurizing said annular cylinder chambers of said piston-and-cylinder assemblies of said travelling beam and said container holder and the full piston area cylinder chambers of the piston and cylinder assemblies of said travelling beam to accelerate said travelling beam and said container holder and said container holder away from said counter beam with the full-piston-area cylinder chambers of the piston-and-cylinder assemblies of the auxiliary cylinder units of the traveling beam being short circuited to the annular cylinder chambers thereof.

* * * * *